US009222209B2

(12) United States Patent
Kim et al.

(10) Patent No.: US 9,222,209 B2
(45) Date of Patent: Dec. 29, 2015

(54) WASHING MACHINE

(71) Applicant: Dongbu Daewoo Electronics Corporation, Seoul (KR)

(72) Inventors: In Dong Kim, Yongin-si (KR); Jeong Hyeon Kim, Anyang-si (KR); Hye Ung Kim, Seoul (KR); Ju Dong Lee, Incheon (KR)

(73) Assignee: DONGBU DAEWOO ELECTRONICS CORPORATION, Seoul (KR)

( * ) Notice: Subject to any disclaimer, the term of this patent is extended or adjusted under 35 U.S.C. 154(b) by 0 days.

(21) Appl. No.: 14/188,619

(22) Filed: Feb. 24, 2014

(65) Prior Publication Data

US 2015/0176176 A1 Jun. 25, 2015

(30) Foreign Application Priority Data

Dec. 20, 2013 (KR) ..... 10-2013-0160225

(51) Int. Cl.
*D06F 37/04* (2006.01)
*D06F 39/08* (2006.01)
*D06F 23/02* (2006.01)
*D06F 23/06* (2006.01)

(52) U.S. Cl.
CPC ..... *D06F 37/04* (2013.01); *D06F 23/025* (2013.01); *D06F 39/088* (2013.01); *D06F 23/065* (2013.01)

(58) Field of Classification Search
CPC ..... D06F 37/04
See application file for complete search history.

(56) References Cited

U.S. PATENT DOCUMENTS 4,941,333 A 7/1990 Blessing

FOREIGN PATENT DOCUMENTS

BE 626305 6/1963
JP H05-076683 3/1993

*Primary Examiner* — Jason Ko

(57) ABSTRACT

A washing machine may include an integrated tub/drum configured to hold water, hold laundry, and rotate; a hollow rotary shaft coupled to an end and/or surface of the integrated tub/drum; a water supply pipe and a drain pipe in the integrated tub/drum and through a passage in the hollow rotary shaft; and a partition in the integrated tub/drum that is configured to separate the laundry from the water supply pipe and the drain pipe and that includes a plurality of holes.

16 Claims, 4 Drawing Sheets

WASHING MACHINE

CROSS-REFERENCE TO RELATED APPLICATIONS

This application is based on and claims priority from Korean Patent Application No. 10-2013-0160225, filed on Dec. 20, 2013, with the Korean Intellectual Property Office, the disclosure of which is incorporated herein in its entirety by reference.

TECHNICAL FIELD

The present disclosure relates to a washing machine, and more particularly, to a washing machine having an integral or unitary tub and drum configured to hold water, accommodate laundry, and rotate.

BACKGROUND

A washing machine is an apparatus that eliminates foreign matter or substances on or in laundry by agitating and/or rotating water, detergent, and the laundry together. Washing machines may be classified into a pulsator-type washing machine that washes the laundry using a water flow generated by operation of a pulsator in a washing tub, and a drum-type washing machine that rotates the drum to wash laundry by dropping the laundry vertically.

The drum-type washing machine has a door that is at the front of the washing machine to place the laundry through the door. The rotating drum drops the laundry into the water and detergent to wash the laundry, and uses relatively small amounts of washing water and detergent. Specifically, a drum-type washing machine in the related art commonly includes a cabinet that forms an external appearance and/or structure of the washing machine, a tub that is in the cabinet and that holds water, a rotatable drum that is in the tub and that accommodates or holds laundry, a drive motor that is installed on or near the tub and that provides power to rotate the drum, a water supply device that supplies water to the tub, and a drain (e.g., a drain valve, pump and/or pipe) that drains water from the tub to the outside of the cabinet after the washing operation ends.

Accordingly, according to the drum-type washing machine in the related art, when the laundry is washed, the laundry is put into the tub in a lateral direction by opening the door at the front of the washing machine, water is supplied to the tub, and then the laundry is washed while lifter(s) in the drum lift up and drop the laundry as the drum rotates by operation of the drive motor.

As such, the drum-type washing machine in the related art typically includes both the tub and the drum. That is, the drum-type washing machine in the related art has a structure that has the tub to hold water and the drum in the tub to rotate and wash the laundry.

However, because the tub is typically made of a plastic material, the tub may be easily contaminated by hard water, scale, mold, mildew, or other foreign substance(s) that enter or form in the tub as the tub is used over a long period of time. There is a problem in that it is difficult to clean the tub because of the presence of the drum when the tub is contaminated. When the tub is contaminated, the tub becomes dirty, corroded, and/or a source of foreign substances and/or contaminants, and then the laundry becomes contaminated, which may cause irritation or skin problems or disease to the user.

This problem also occurs in the pulsator-type washing machines as well as the drum-type washing machines. Pulsator-type washing machines also include a reservoir (tub) in the main body thereof.

According to the drum-type washing machine in the related art, the drum is rotated by a single shaft coupled to one side of the drum. Consequently, there is also vibration and/or noise problem(s) that may occur due to deflection of the single shaft.

SUMMARY

The present disclosure has been made in an effort to provide a washing machine that uses an integrated, one-piece and/or unitary tub and/or drum ("an integrated tub/drum"), thereby suppressing the generation of mold, mildew, scale, and other contaminants on the inner surface(s) thereof and allowing the integrated tub/drum to be easily cleaned.

The present disclosure has been made in an effort to provide a washing machine that may effectively supply water to an integrated tub/drum and drain water from the integrated tub/drum.

The present disclosure has been made in an effort to provide a washing machine that may use a partition in the integrated tub/drum to separate laundry from a water supply pipe and a drain pipe to prevent the laundry from clogging, obstructing, and/or interfering with the drainage of water from the integrated tub/drum through the drain pipe, and/or prevent the water supply pipe and/or the drain pipe from damaging the laundry in the integrated tub/drum (and vice versa).

One or more exemplary embodiments of the present disclosure provide a washing machine including an integrated tub/drum configured to hold water, hold laundry, and rotate; a hollow rotary shaft that is coupled to an end and/or surface of the integrated tub/drum; a water supply pipe and a drain pipe in the integrated tub/drum and through the hollow rotary shaft; and a partition in the integrated tub/drum that separates the laundry from the water supply pipe and the drain pipe and that includes a plurality of holes therein.

The integrated tub/drum may have a cylindrical or truncated conical shape. The hollow rotary shaft may be coupled to and/or pass through an end and/or surface of the integrated tub/drum that may have a relatively large surface area. The partition may face the inner side of the end and/or surface of the integrated tub/drum that has the relatively large surface area.

A portion or end of the drain pipe that is in the integrated tub/drum may extend and/or bend away from the hollow rotary shaft in a predetermined direction (e.g., downward).

A portion or end of the water supply pipe that is in the integrated tub/drum may extend and/or bend away from the hollow rotary shaft in a different direction (e.g., upward and/or leftward or rightward).

The washing machine may further include a drive shaft that is coupled to another end and/or surface of the integrated tub/drum (e.g., the vertical end and/or surface of the integrated tub/drum away from or opposite to the end and/or surface to and/or through which the hollow rotary shaft is coupled and/or passes); and a drive motor that rotates the drive shaft.

According to exemplary embodiments of the present disclosure, the washing machine includes an integrated tub/drum, thereby suppressing or preventing the formation and/or generation of mold, mildew, scale, or other contaminants on the inner surface(s) of the integrated tub/drum, and allowing the integrated tub/drum to be easily cleaned.

According to exemplary embodiments of the present disclosure, the washing machine may effectively supply water to the integrated tub/drum and/or drain the water from the integrated tub/drum.

According to exemplary embodiments of the present disclosure, the washing machine may use a partition in the integrated tub/drum to separate laundry from the water supply pipe and drain pipe, and prevent the laundry from clogging, obstructing, and/or interfering with the drainage of water from the integrated tub/drum through the drain pipe, and/or prevent the water supply pipe and/or the drain pipe from damaging the laundry (or vice versa).

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
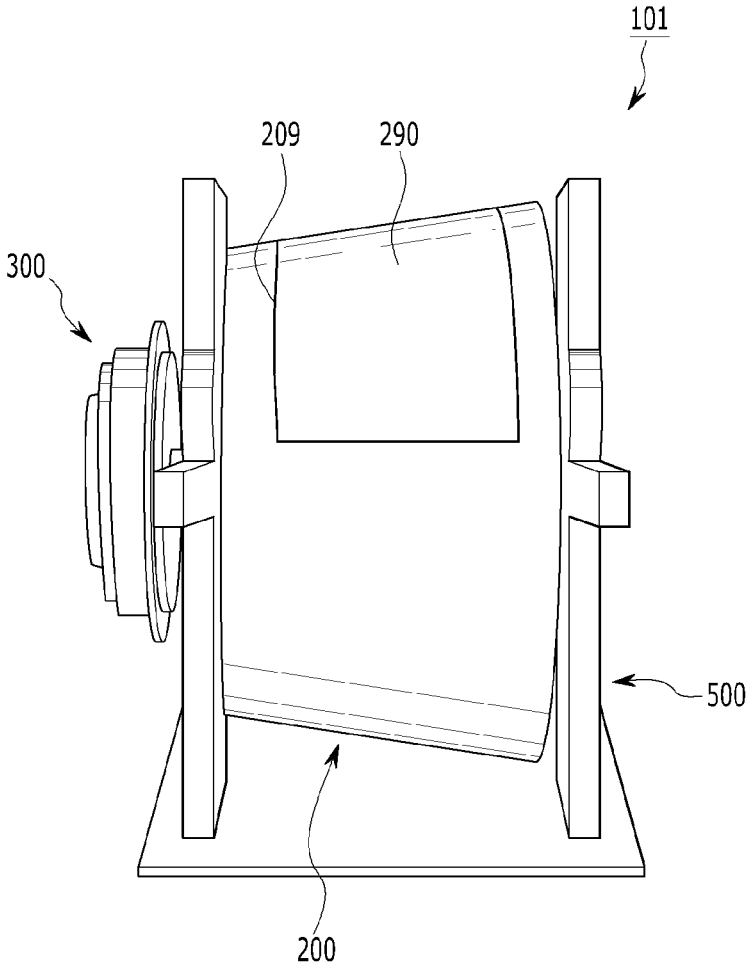
FIG. 1 is a perspective view of an exemplary washing machine according to one or more embodiments of the present disclosure.

In the following detailed description, reference is made to the accompanying drawings, which form a part hereof. The illustrative embodiments described in the detailed description, drawings, and claims are not meant to be limiting. Other embodiments may be utilized, and other changes may be made, without departing from the spirit or scope of the subject matter presented here.

Hereinafter, one or more exemplary embodiments of the present disclosure will be described in detail with reference to the accompanying drawings so that those skilled in the technical field to which the present disclosure pertains may carry out the exemplary embodiments. The present disclosure may be implemented in various different forms, and is not limited to the exemplary embodiment(s) described herein.

The drawings are schematically illustrated, and the scales of the drawings are not necessarily identical to each other or necessarily to scale. Relative dimensions and ratios of the parts illustrated in the drawings may be exaggerated or reduced in size(s) thereof for clarification of the drawings and convenience, and any particular dimension is only illustrative, and is not limited thereto. The same structures, elements or components illustrated in two or more drawings may be designated by the same reference numerals to illustrate the same or similar features.

The exemplary embodiments of the present disclosure are specifically presented as ideal embodiments. As a result, various modifications of the drawings are expected. Therefore, the disclosed exemplary embodiments are not limited to specific forms or regions illustrated in the drawings, and for example, include modifications of form by manufacturing.

Hereinafter, a washing machine 101 according to exemplary embodiments of the present disclosure will be described with reference to FIGS. 1 to 4.

Figure 2:
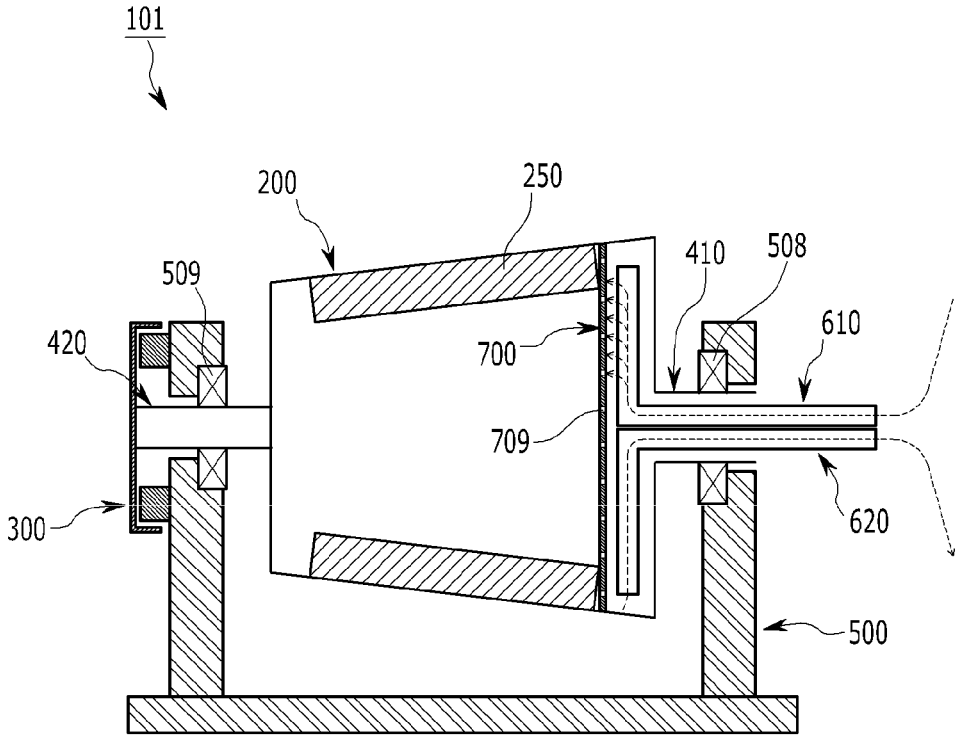
FIG. 2 is a cross-sectional view of the exemplary washing machine of FIG. 1.

As illustrated in FIGS. 1 and 2, the washing machine 101 according to exemplary embodiments of the present disclosure includes an integrated tub/drum 200, a hollow rotary shaft 410, a water supply pipe 610, a drain pipe 620, and a partition 700.

The washing machine 101 according to exemplary embodiments of the present disclosure may further include one or more lifters 250, a supporting frame 500, a support bearing 508, a drive bearing 509, a drive shaft 420, and a drive motor 300.

Figure 4:
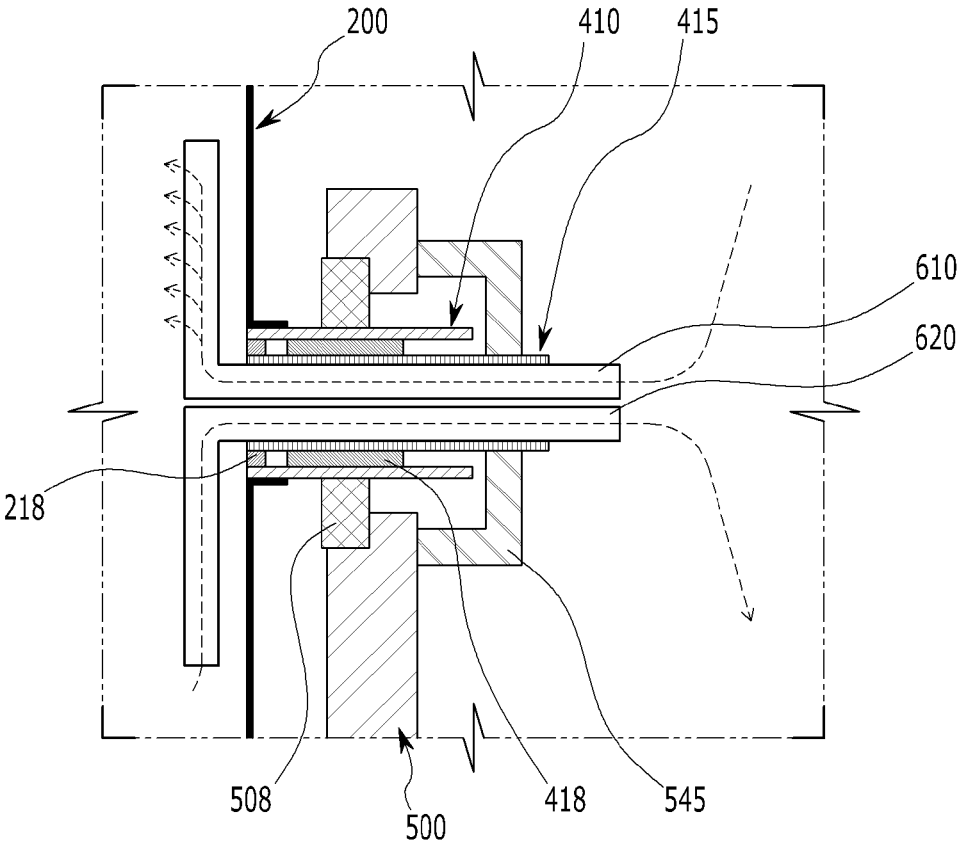
FIG. 4 is an enlarged cross-sectional view of the exemplary hollow rotary shaft in FIG. 2.

As illustrated in FIG. 4, the washing machine 101 according to exemplary embodiments of the present disclosure may further include a fixed shaft 415, a rotary bearing 418, a water seal 218, and a shaft fixing mechanism or brace 545.

Although not illustrated, the exemplary washing machine 101 may further include a cabinet or housing, a water supply pump and/or valve, and/or a drain pump.

The cabinet or housing forms an external shape, structure and/or appearance of the washing machine 101, and a control panel for controlling the washing machine 101 may be installed in and/or on the cabinet. Because the cabinet may have any of various shapes that are known to those skilled in the art, a detailed description thereof will be omitted.

The water supply pump and the drain pump (which may be separate pumps, or only one pump providing both functions) supplies water to the integrated tub/drum 200 through the water supply pipe 610 or drains water from the integrated tub/drum 200 through the drain pipe 620. Because the water supply pump and/or valve and the drain pump in the washing machine 101 are also known to those skilled in the art, a detailed description thereof will be omitted.

The integrated tub/drum 200 is configured to hold water, hold laundry, and rotate. The integrated tub/drum 200 may comprise or be made of stainless steel. Alternatively, the integrated tub/drum 200 may comprise or be made of metal and/or plastic, and have a ceramic and/or stain-resistant coating on the inner surface thereof. That is, according to various exemplary embodiments of the present disclosure, the integrated tub/drum 200 is not easily contaminated by hard water, scale, mold, mildew, or other foreign substance(s), and may be easily cleaned even if the integrated tub/drum 200 becomes contaminated. In a typical washing machine having a tub and a separate drum, there is a problem because the drum needs to be separated from the interior of or removed from the tub in order to clean the tub. It is inconvenient and/or difficult to remove or separate the drum from the tub. Unlike the typical washing machine, the exemplary washing machine 101 has the integrated tub/drum 200 that may be easily cleaned.

In exemplary embodiments of the present disclosure, the integrated tub/drum 200 has a truncated conical shape having vertical ends and/or surfaces that intersect a central rotation axis of the integrated tub/drum 200 and that have different surface areas. One vertical end and/or surface of the integrated tub/drum 200 may have a relatively large area, while an opposite end and/or surface of the integrated tub/drum 200 may have a relatively small area. Also, the integrated tub/drum 200 may have a circumferential surface that may couple to the vertical ends and/or surfaces of the integrated tub/drum 200. However, exemplary embodiments of the present disclosure are not particularly limited thereto, and the integrated tub/drum 200 may also have a cylindrical shape, "barrel" shape, or other shape.

As shown in FIG. 1, the integrated tub/drum 200 may include an opening 209 in the circumferential surface of the integrated tub/drum 200. The laundry may be put into the integrated tub/drum 200, or the laundry in the integrated tub/drum 200 may be taken out of the integrated tub/drum 200, through the opening 209.

The washing machine 101 according to exemplary embodiments of the present disclosure may further include a drum cover 290 that is separably or removably coupled to the opening 209 of the integrated tub/drum 200. The drum cover 290 is opened or removed from the integrated tub/drum 200 when the laundry is put into or taken out of the integrated tub/drum 200, and coupled to the integrated tub/drum 200 to tightly close the opening 209 of the integrated tub/drum 200 to seal an internal space of the integrated tub/drum 200 when the laundry is washed. In one embodiment, the cover 290 slides into place along snug and/or watertight grooves in the integrated tub/drum 200 at the opening 209. In another embodiment, the cover 290 is secured in place over the opening 209 by one or more clasps (and optionally, one or more mating tabs and recesses), and a gasket or seal may be along the periphery of the opening 209 and/or cover 290.

Figure 3:
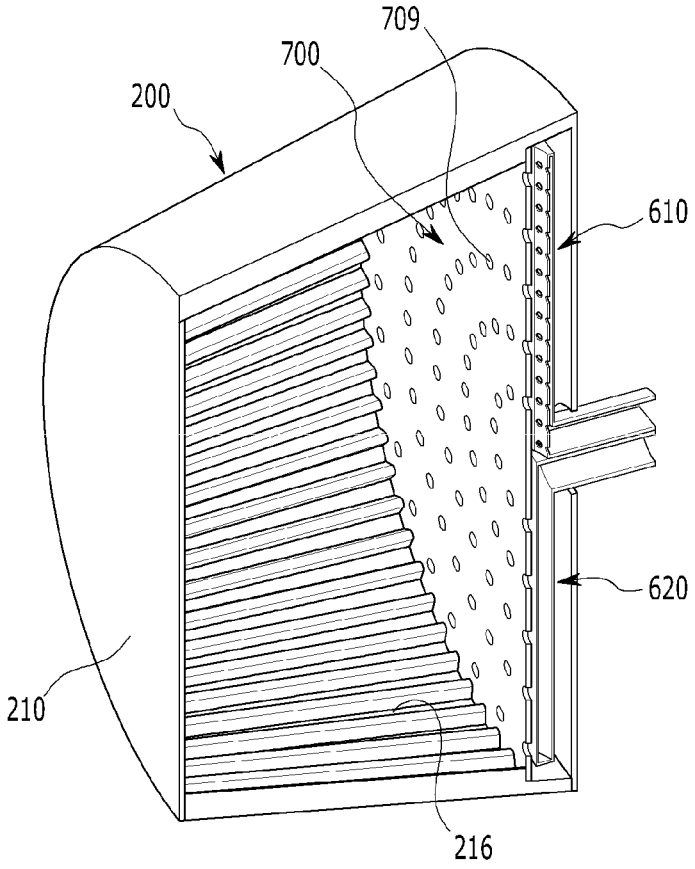
FIG. 3 is a cross-sectional perspective view of the exemplary integrated tub/drum in FIG. 2.

As illustrated in FIG. 3, in exemplary embodiments of the present disclosure, the integrated tub/drum 200 may have a plurality of grooves or troughs 216 along the inner circumferential surface thereof, in parallel, and extending from one vertical end or surface to the other vertical end or surface. The grooves or troughs 216 guide water in the integrated tub/drum 200 toward the drain pipe 620 so that the water drains through the drain pipe 620 when the laundry is spin-dried. The grooves or troughs 216 may be in or on an inner circumferential surface of the integrated tub/drum 200 between the end and/or surface of the integrated tub/drum 200 that may have the relatively large surface area and the other end and/or surface of the integrated tub/drum 200 that may have the relatively small surface area. Water from a washing operation and/or that is removed or separated from the laundry is directed toward the drain pipe 620 by flowing along the grooves or troughs 216. Beneficially, the grooves or troughs 216 also provide additional surface area and/or a frictional force when laundry is washed in the integrated tub/drum 200, thereby improving washing effectiveness and/or washing efficiency and obtaining cleaner washed laundry.

As illustrated in FIG. 2, a plurality of lifters 250 may be inside the integrated tub/drum 200. The lifters 250 have a substantially rectangular, sloped rectangular, or bar shape that extends or protrudes from an inner circumferential surface of the integrated tub/drum 200 at or to a predetermined height toward a center of the integrated tub/drum 200.

Accordingly, when the integrated tub/drum 200 rotates, the laundry in the integrated tub/drum 200 is washed by being lifted up by the lifters 250 due to rotational force of the integrated tub/drum 200 and dropped back into the wash water and detergent.

The hollow rotary shaft 410 is coupled to and/or passes through an end and/or surface (e.g., a vertical and/or substantially circular end or surface) of the integrated tub/drum 200 that may have a relatively large surface area. A passage or opening in the hollow rotary shaft 410 communicates with the interior of the integrated tub/drum 200. Further, a portion or end of the drain pipe 620 that is in the integrated tub/drum 200 and that may extend and/or bend downward is also adjacent to the relatively large end and/or surface of the integrated tub/drum 200.

Both the water supply pipe 610 and the drain pipe 620 are in the integrated tub/drum 200 and through the passage or opening in the hollow rotary shaft 410. The water supply pipe 610 supplies water to the interior of the integrated tub/drum 200, and the drain pipe 620 drains water from the interior of the integrated tub/drum 200.

In exemplary embodiments of the present disclosure, the drain pipe 620 may be in the integrated tub/drum 200 and pass through the passage or opening in the hollow rotary shaft 410. A portion or end of the drain pipe 620 that is in the integrated tub/drum 200 may extend and/or bend away from the hollow rotary shaft 410 in a particular direction (e.g., downward). FIG. 2 illustrates one exemplary embodiment in which the drain pipe 620 bends downward, but embodiments of the present disclosure are not necessarily limited thereto.

When the integrated tub/drum 200 has a truncated conical shape, the hollow rotary shaft 410 may be coupled to and/or pass through an end and/or surface (e.g., a substantially circular and/or vertical end) of the integrated tub/drum 200 that may have a relatively large area.

The end and/or surface of the integrated tub/drum to which the hollow rotary shaft 410 is coupled may have a relatively large surface area. The portion or end of the drain pipe 620 that is in the integrated tub/drum 200 and that may extend and/or bend (e.g., downward) may also be adjacent to the relatively large end and/or surface of the integrated tub/drum 200.

Accordingly, the gradient of the integrated tub/drum 200 having a truncated conical shape and the grooves or troughs 216 in or on the inner circumferential surface of the integrated tub/drum 200 may cause the water in the integrated tub/drum 200 to collect in an area near or at the relatively large end and/or surface of the integrated tub/drum 200.

Accordingly, the drain pipe 620 may effectively drain the collected water from the area near or at the relatively large end and/or surface of the integrated tub/drum 200.

In exemplary embodiments of the present disclosure, the water supply pipe 610 may be in the integrated tub/drum 200 and pass through the passage or opening in the hollow rotary shaft 410. A portion or end of the water supply pipe 610 that is in the integrated tub/drum 200 may extend and/or bend away from the hollow rotary shaft 410 in a particular direction (e.g., upward, and/or leftward or rightward). FIG. 2 illustrates one exemplary embodiment in which the water supply pipe 610 bends upward, but exemplary embodiments of the present disclosure are not limited thereto. The water supply pipe 610 may bend in other directions, or may not bend at all.

As illustrated in FIGS. 2 and 3, in exemplary embodiments of the present disclosure, the integrated tub/drum 200 may have a partition 700 in the internal space of the integrated tub/drum 200 to separate the laundry from the water supply pipe 610 and the drain pipe 620. That is, the partition 700 forms a barrier between the laundry and both the water supply pipe 610 and the drain pipe 620. FIGS. 2 and 3 illustrate one exemplary embodiment in which the partition 700 has a wall structure, but exemplary embodiments of the present disclosure are not limited thereto. The partition 700 may have a mesh structure or other type of structure. Additionally, the partition 700 may be near and/or face an inner side of the end and/or surface of the integrated tub/drum that is coupled to the hollow rotary shaft 410 and that may have the relatively large surface area.

Both the portion of the water supply pipe 610 in the integrated tub/drum 200 and the portion of the drain pipe 620 in the integrated tub/drum 200 are between the partition 700 and the inner side of the end and/or surface of the integrated tub/drum that is coupled to the hollow rotary shaft 410. That is, the partition 700 prevents the laundry in the integrated tub/drum 200 from contacting or touching both the portion of the water supply pipe 610 in the integrated tub/drum 200 and the portion of the drain pipe 620 in the integrated tub/drum 200.

The partition 700 may have a plurality of holes 709 to allow water to move into and/or out of the integrated tub/drum 200 through the water supply pipe 610 and the drain pipe 620. Since water separated or removed from the laundry is directed toward the drain pipe 620 by the grooves or troughs 216, the partition 700 may also have holes 709 at an interface with (e.g., at the bottom of) the grooves or troughs 216. FIG. 3 illustrates one exemplary embodiment of a radial pattern for the holes 709 through the partition 700, but exemplary embodiments of the present disclosure are not limited thereto. The holes 709 may have one or more other patterns through the partition 700. In an embodiment, the holes 709 may be aligned with and/or overlap a plurality of water output holes in the water supply pipe 610 to prevent or to minimize obstructing and/or interfering with the supply of water through the water supply pipe 610 into the integrated tub/drum 200. This may be particularly beneficial when the washing machine has a controller configured to stop rotation of the integrated tub/drum when the opening is facing upwards (e.g., is at or between 10 o'clock and 2 o'clock when facing a vertical end or surface of the integrated tub/drum 200), in which case a single row or line of holes 709 can be aligned with corresponding holes in the water supply pipe 610.

The partition 700 prevents the laundry in the integrated tub/drum 200 from clogging, obstructing, and/or interfering with the water supply pipe 610 and/or the drain pipe 620. When water drains from the integrated tub/drum 200 through the drain pipe 620, the partition 700 prevents the laundry from clogging, obstructing, and/or interfering with the drainage of the water through the drain pipe 620.

The partition 700 prevents the water supply pipe 610 and/or the drain pipe 620 from damaging the laundry in the integrated tub/drum 200 (or vice versa) when the laundry rotates in the integrated tub/drum 200.

Even when the integrated tub/drum 200 rotates, the water supply pipe 610 in the integrated tub/drum 200 and the drain pipe 620 in the integrated tub/drum 200 do not rotate. Therefore, when the partition 700 is not provided, the laundry in the integrated tub/drum 200 may become tangled with and/or damaged by the water supply pipe 610 and/or the drain pipe 620 while the laundry rotates in the integrated tub/drum 200 that rotates to wash the laundry.

The supporting frame 500 supports the hollow rotary shaft 410 so that the hollow rotary shaft 410 can rotate. The supporting frame 500 may be accommodated in or coupled to the cabinet (not illustrated). The supporting frame 500 may have one or more shapes such as an intersecting 'X' shape, and the hollow rotary shaft 410 may be supported at the intersection thereof. Alternatively, the frame 500 may have a V or inverted V shape (with the hollow rotary shaft 410 at the point or vertex of the V), or other shape or form that supports the integrated tub/drum 200 and rotary shaft 410.

However, exemplary embodiments of the present disclosure are not limited thereto, and the supporting frame 500 may have various shapes and/or comprise various structures that may be modified and carried out by those skilled in the art based on the known technology.

As illustrated in FIG. 4, the fixed shaft 415 is in the passage or opening of the hollow rotary shaft 410 and does not rotate. The fixed shaft 415 supports the water supply pipe 610 and the drain pipe 620 therein. That is, when the hollow rotary shaft 410 rotates, the water supply pipe 610 and the drain pipe 620 in the fixed shaft 415 do not rotate.

One end of the fixed shaft 415 extends or protrudes outside of the hollow rotary shaft 410 (e.g., away from the integrated tub/drum 200), and the shaft fixing mechanism or brace 545 connects the one end of the fixed shaft 415 to the supporting frame 500. That is, the shaft fixing mechanism or brace 545 is coupled to the supporting frame 500 to support the fixed shaft 415 so that the fixed shaft 415 does not rotate in the hollow rotary shaft 410.

The rotary bearing 418 is between the hollow rotary shaft 410 and the fixed shaft 415 so that the hollow rotary shaft 410 and the fixed shaft 415 are slidable or rotatable relative to each other. That is, by the rotary bearing 418, the hollow rotary shaft 410 may rotate while the fixed shaft 415 is fixed. For example, the rotary bearing 418 may comprise a needle roller bearing.

The water seal 218 is between the hollow rotary shaft 410 and the fixed shaft 415, at an interface with the integrated tub/drum 200, to block or prevent the water in the integrated tub/drum 200 from flowing into the rotary bearing 418 through the passage or opening in the hollow rotary shaft 410.

The supporting bearing 508 is between the hollow rotary shaft 410 and the supporting frame 500. That is, the supporting bearing 508 helps the supporting frame 500 to support the hollow rotary shaft 410 and enable the hollow rotary shaft 410 to rotate.

As illustrated in FIG. 2, the drive shaft 420 is coupled to another (vertical) end and/or surface of the integrated tub/drum 200, opposite to the end and/or surface to which the hollow rotary shaft 410 is coupled. The other vertical end and/or surface may have a relatively small surface area. That is, the integrated tub/drum 200 rotates while being supported by the drive shaft 420 and the hollow rotary shaft 410.

Like the hollow rotary shaft 410, the drive shaft 420 is also supported by the support frame 500. The drive shaft 420 may also be supported at the intersection or vertex of a corresponding support structure in the support frame 500.

The drive bearing 509 is between the drive shaft 420 and the supporting frame 500. That is, the drive bearing 509 helps the support frame 500 to support the drive shaft 420 and enable the drive shaft 420 to rotate.

The drive motor 300 rotates the drive shaft 420, and provides rotational power to the integrated tub/drum 200.

In exemplary embodiments of the present disclosure, the drive motor 300 may rotate the integrated tub/drum 200 to position the opening 209 of the integrated tub/drum 200 at a relatively upper or upward-facing location when the laundry is put into or taken out of the integrated tub/drum 200. That is, the drive motor 300 may move the opening 209 of the integrated tub/drum 200 to a position that is convenient for a user to put the laundry into the integrated tub/drum 200 or to take the laundry out of the integrated tub/drum 200.

According to the aforementioned exemplary embodiments of the present disclosure, the washing machine 101 uses the integrated tub/drum 200 to suppress the formation and/or generation of mold, scale, and other contaminants on the inner surface(s) thereof and to allow the integrated tub/drum 200 to be easily cleaned.

According to exemplary embodiments of the present disclosure, the washing machine 101 may effectively supply water to the integrated tub/drum 200 and/or drain water from the integrated tub/drum 200.

According to exemplary embodiments of the present disclosure, the washing machine 101 may use the partition 700 in the integrated tub/drum 200 to separate the laundry from the water supply pipe 610 and the drain pipe 620 to prevent the laundry from clogging, obstructing, and/or interfering with the drainage of water from the integrated tub/drum 200 through the drain pipe 620, and/or prevent the water supply pipe 610 and/or the drain pipe 620 from damaging the laundry in the integrated tub/drum 200 (or vice versa).

According to exemplary embodiments of the present disclosure, the drive shaft 420 and the hollow rotary shaft 410 rotate while supporting both ends and/or surfaces of the integrated tub/drum 200 that are opposite to each other to reduce and/or prevent cantilevered beam deflection of the shaft, in comparison to the case in which the drum is rotated with a single shaft connected to one end and/or surface of the drum, thereby reducing vibration and/or noise.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A washing machine comprising:

an integrated tub/drum configured to hold water, hold laundry, and rotate;

a hollow rotary shaft coupled to an end and/or surface of the integrated tub/drum;

a water supply pipe and a drain pipe in the integrated tub/drum and through a passage in the hollow rotary shaft; and a partition in the integrated tub/drum that is configured to separate the laundry from the water supply pipe and the drain pipe and that includes a plurality of holes, wherein a portion of the drain pipe in the integrated tub/drum bends away from the hollow rotary shaft in a downward direction, wherein a portion of the water supply pipe in the integrated tub/drum bends away from the hollow rotary shaft in at least one of an upward, a leftward, and a rightward direction, wherein the partition prevents the water supply pipe and the drain pipe from damaging the laundry in the integrated tub/drum when the laundry rotates in the integrated tub/drum.

2. The washing machine of claim 1, wherein the integrated tub/drum has a truncated conical shape comprising a large end surface area and a small end surface area.

3. The washing machine of claim 2, wherein the hollow rotary shaft is coupled to the large end surface area and configured to rotate.

4. The washing machine of claim 3, wherein the partition faces an inner side of the end and/or surface of the integrated tub/drum that has the large end surface area.

5. The washing machine of claim 1, further comprising:

a drive shaft coupled to an opposite end and/or surface of the integrated tub/drum from the end and/or surface to which the hollow rotary shaft is coupled; and a drive motor configured to rotate the drive shaft.

6. The washing machine of claim 2, further comprising:

a drive shaft coupled to an opposite end and/or surface of the integrated tub/drum from the end and/or surface to which the hollow rotary shaft is coupled; and a drive motor configured to rotate the drive shaft.

7. The washing machine of claim 3, further comprising:

a drive shaft coupled to an opposite end and/or surface of the integrated tub/drum from the end and/or surface to which the hollow rotary shaft is coupled; and a drive motor configured to rotate the drive shaft.

8. The washing machine of claim 4, further comprising:

a drive shaft coupled to an opposite end and/or surface of the integrated tub/drum from the end and/or surface to which the hollow rotary shaft is coupled; and a drive motor configured to rotate the drive shaft.

9. The washing machine of claim 1, further comprising:

a drive shaft coupled to an opposite end and/or surface of the integrated tub/drum from the end and/or surface to which the hollow rotary shaft is coupled; and a drive motor configured to rotate the drive shaft.

10. The washing machine of claim 1, further comprising:

a drive shaft coupled to an opposite end and/or surface of the integrated tub/drum from the end and/or surface to which the hollow rotary shaft is coupled; and a drive motor configured to rotate the drive shaft.

11. The washing machine of claim 1, wherein the integrated tub/drum has a plurality of grooves or troughs along the inner circumferential surface thereof.

12. The washing machine of claim 11, wherein the plurality of grooves or troughs are in parallel, and extend from one vertical end or surface of the integrated tub/drum to another vertical end or surface of the integrated tub/drum.

13. The washing machine of claim 11, wherein one or more of the plurality of holes are aligned with one or more of the plurality of grooves or troughs.

14. The washing machine of claim 11, wherein the integrated tub/drum includes an opening in the circumferential surface thereof, configured to allow a user to place laundry in and remove laundry from the integrated tub/drum.

15. The washing machine of claim 11, further comprising a controller configured to stop rotation of the integrated tub/drum when the opening in the integrated tub/drum is facing upwards.

16. The washing machine of claim 15, wherein a subset of the plurality of holes are aligned with holes in the water supply pipe.

* * * * *